US009780457B2

(12) United States Patent
Bradley et al.

(10) Patent No.: US 9,780,457 B2
(45) Date of Patent: Oct. 3, 2017

(54) MULTI-BEAM ANTENNA WITH MODULAR LUNEBURG LENS AND METHOD OF LENS MANUFACTURE

(71) Applicant: CommScope Technologies LLC, Hickory, NC (US)

(72) Inventors: Eddie Ray Bradley, Allen, TX (US); Igor E. Timofeev, Dallas, TX (US); Michael F. Bonczyk, Anna, TX (US); William H. Burnett, Plano, TX (US)

(73) Assignee: CommScope Technologies LLC, Hickory, NC (US)

( * ) Notice: Subject to any disclaimer, the term of this patent is extended or adjusted under 35 U.S.C. 154(b) by 565 days.

(21) Appl. No.: 14/244,369

(22) Filed: Apr. 3, 2014

(65) Prior Publication Data

US 2015/0070230 A1 Mar. 12, 2015

Related U.S. Application Data

(60) Provisional application No. 61/875,491, filed on Sep. 9, 2013.

(51) Int. Cl.

| | |
|---|---|
| ***H01Q 21/00*** | (2006.01) |
| ***H01Q 19/06*** | (2006.01) |
| ***H01Q 1/24*** | (2006.01) |
| ***H01Q 1/42*** | (2006.01) |
| ***H01Q 15/08*** | (2006.01) |
| ***H01Q 21/06*** | (2006.01) |
| ***H01Q 21/24*** | (2006.01) |
| ***H01Q 21/08*** | (2006.01) |

(52) U.S. Cl.
CPC ..... *H01Q 19/062* (2013.01); *H01Q 1/246* (2013.01); *H01Q 1/42* (2013.01); *H01Q 15/08* (2013.01); *H01Q 19/06* (2013.01); *H01Q 21/062* (2013.01); *H01Q 21/08* (2013.01); *H01Q 21/24* (2013.01)

(58) Field of Classification Search
CPC ..... H01Q 19/06; H01Q 1/42; H01Q 19/062; H01Q 21/24; H01Q 1/246; H01Q 21/08; H01Q 21/062; H01Q 15/08
USPC ..... 343/753, 911 R, 911 L
See application file for complete search history.

(56) References Cited

U.S. PATENT DOCUMENTS 3,781,900 A * 12/1973 Fuller ..... H01Q 15/08 343/911 L
6,313,802 B1 * 11/2001 Petersson ..... H01Q 15/04 343/753

(Continued)

*Primary Examiner* — Trinh Dinh
(74) *Attorney, Agent, or Firm* — Myers Bigel, P.A.

(57) ABSTRACT

A multiple beam antenna system is described. The system may include a mounting structure, a first wireless access antenna, a second wireless access antenna, and a radio frequency lens. The first and second wireless access antennas may be mounted to the mounting structure. Columns of radiating elements of the first and second wireless access antennas may be aligned with the radio frequency lens. The radio frequency lens may be modular in a longitudinal or radial direction, or in both directions. The radio frequency lens may include a plurality of compartments arranged to form a first cylinder made up of concentric, coaxial cylinders and a plurality of dielectric materials in at least some of the plurality of compartments.

17 Claims, 8 Drawing Sheets

(56) References Cited

U.S. PATENT DOCUMENTS

| | | | | |
|---|---|---|---|---|
| 6,426,814 | B1 * | 7/2002 | Berger | H01Q 3/245 343/753 |
| 6,433,936 | B1 * | 8/2002 | Carpenter | B29C 39/025 264/1.7 |
| 7,671,820 | B2 * | 3/2010 | Tokoro | C04B 38/06 343/753 |
| 2002/0067317 | A1 * | 6/2002 | Sakurada | H01B 3/12 343/911 R |
| 2003/0038752 | A1 * | 2/2003 | Park | F41G 7/2246 343/757 |
| 2007/0008236 | A1 | 1/2007 | Tillery | |
| 2008/0278394 | A1 | 11/2008 | Koh | |
| 2009/0191952 | A1 * | 7/2009 | Nagano | G07F 17/32 463/25 |
| 2009/0296223 | A1 | 12/2009 | Werner | |
| 2009/0315794 | A1 * | 12/2009 | Alamouti | H01Q 1/007 343/753 |
| 2011/0003131 | A1 * | 1/2011 | Matitsine | C08J 9/0085 428/296.4 |
| 2012/0098725 | A1 | 4/2012 | Lytle | |
| 2014/0176377 | A1 * | 6/2014 | Merlet | H01Q 15/10 343/753 |
| 2015/0070230 | A1 | 3/2015 | Bradley | |

* cited by examiner

MULTI-BEAM ANTENNA WITH MODULAR LUNEBURG LENS AND METHOD OF LENS MANUFACTURE

CROSS REFERENCE TO RELATED APPLICATIONS

This application claims priority to U.S. Provisional Application Ser. No. 61/875,491 filed Sep. 9, 2013, which is hereby incorporated by reference in its entirety.

BACKGROUND

The present inventions generally relate to radio communications and, more particularly, to multi-beam antennas utilized in cellular communication systems.

Cellular communication systems derive their name from the fact that areas of communication coverage are mapped into cells. Each such cell is provided with one or more antennas configured to provide two-way radio/RF communication with mobile subscribers geographically positioned within that given cell. One or more antennas may serve the cell, where multiple antennas commonly utilized are each configured to serve a sector of the cell. Typically, these plurality of sector antennas are configured on a tower, with the radiation beam(s) being generated by each antenna directed outwardly to serve the respective cell.

A common wireless communication network plan involves a base station serving three hexagonal shaped cells or sectors. This is often known as a tri-cellular configuration. In a tri-cellular configuration, a given base station antenna serves a 120° sector. Typically, a 65° Half Power Beamwidth (HPBW) antenna provides coverage for a 120° sector. Three of these 120° sectors provide 360° coverage. Other sectorization schemes may also be employed. For example, six, nine, and twelve sector base stations have been proposed. Six sector sites may involve six directional base station antennas, each having a 33° HPBW antenna serving a 60° sector. In other proposed solutions, a single, multi-column array may be driven by a feed network to produce two or more orthogonal beams from a single aperture. See, for example, U.S. Patent Pub. No. 20110205119, which is incorporated by reference.

Increasing the number of sectors increases system capacity because each antenna can service a smaller area. However, dividing a coverage area into smaller sectors has drawbacks because antennas covering narrow sectors generally have more radiating elements that are spaced wider than antennas covering wider sectors. For example, a typical 33° HPBW antenna is generally two times wider than a common 65° HPBW antenna. Thus, costs and space requirements increase as a cell is divided into a greater number of sectors.

SUMMARY OF THE INVENTION

The present inventions achieve technical advantages by using a variation of a Luneburg lens to narrow an antenna's beamwidth and increase its associated gain. This enables the use of less expensive and less cumbersome antennas to cover smaller areas while simultaneously increasing overall system capacity and decreasing interference across sectors. In some embodiments, the lens includes a modular design that allows for the lens size to be changed easily and efficiently.

In one embodiment, a multiple beam antenna system includes a mounting structure, a first wireless access antenna, a second wireless access antenna, and a radio frequency lens. The mounting structure includes a first set of mounting points and a second set of mounting points. The first wireless access antenna has at least one column of first radiating elements having a first longitudinal axis, and the first wireless access antenna is mounted on the first set of mounting points. The second wireless access antenna has at least one column of second radiating elements having a second longitudinal axis, and the second wireless access antenna is mounted on the second set of mounting points. The radio frequency lens has a third longitudinal axis and is disposed such that the third longitudinal axis is substantially aligned with the first longitudinal axis and the second longitudinal axis.

In one embodiment, the radio frequency lens includes a plurality of compartments arranged to form a first cylinder including a set of concentric, coaxial cylinders, and a plurality of dielectric materials in at least some of the plurality of compartments.

In another embodiment, the radio frequency lens includes a plurality of cylinders, the cylinders being concentric and coaxial to one another, and a plurality of ribs intersecting at least some of the plurality of cylinders to form a plurality of compartments for holding dielectric materials. The ribs may extend outward past the outermost cylinder to form a plurality of outer grooves, and a plurality of dielectric panels may be fit in the plurality of outer grooves. The lens may also include a film bag for containing the plurality of cylinders, the plurality of ribs, the dielectric materials, and the plurality of dielectric panels. The film bag may be vacuum sealed around the plurality of cylinders, the plurality of ribs, the dielectric materials, and the plurality of dielectric panels.

In another embodiment, the radio frequency lens includes a plurality of cylindrical lens segments. Each cylindrical lens segment includes an inner compartment for holding dielectric materials and at least two outer grooves for holding dielectric panels. The cylindrical lens segments are stacked along the longitudinal axes of the cylindrical lens segments. A film bag is also included for containing the plurality of cylindrical lens segments, the dielectric materials, and the dielectric panels.

DETAILED DESCRIPTION OF THE PREFERRED EMBODIMENTS

Figure 1:
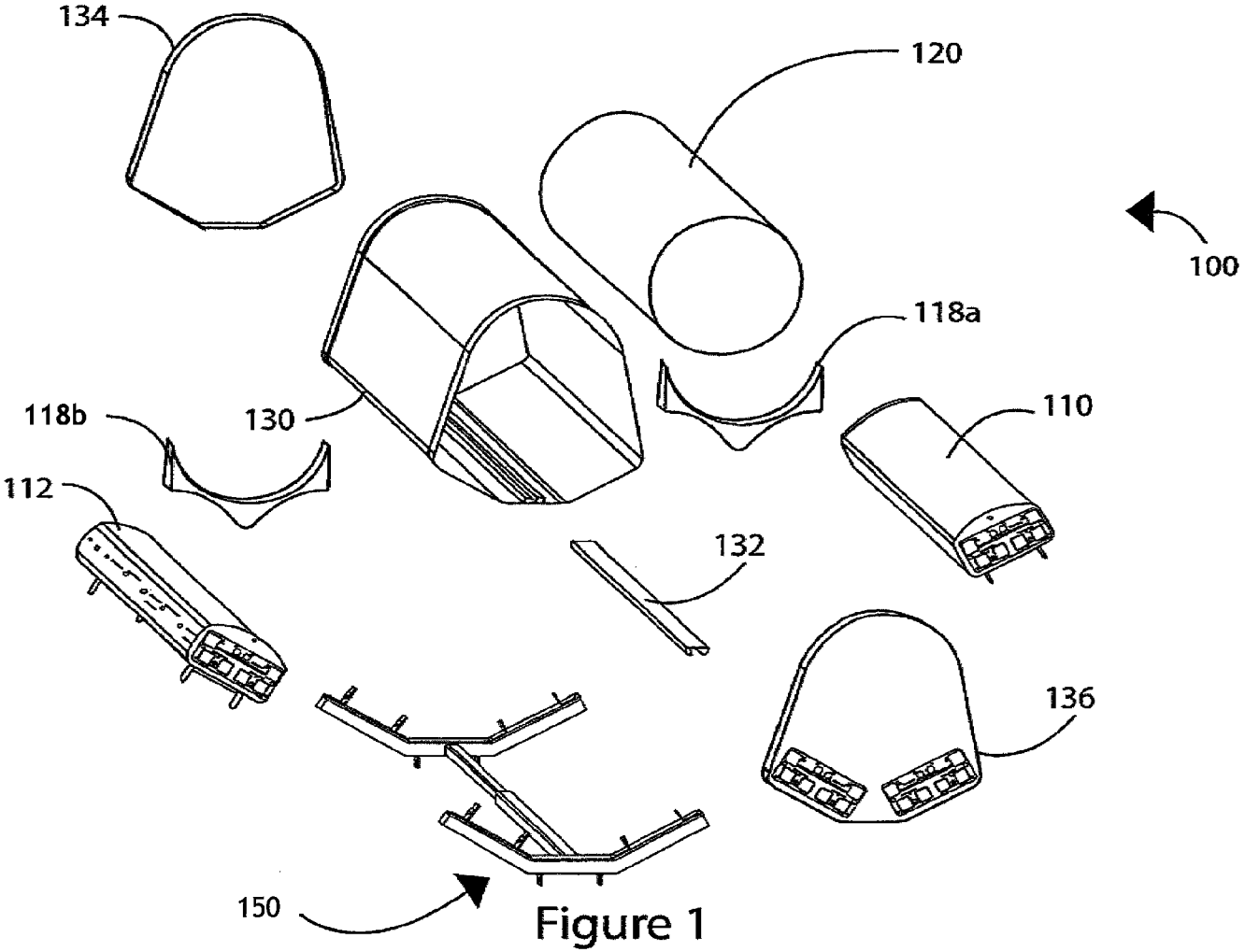
FIG. 1 is a diagram showing an exploded view of an exemplary multiple beam base station antenna system.
Figure 2:
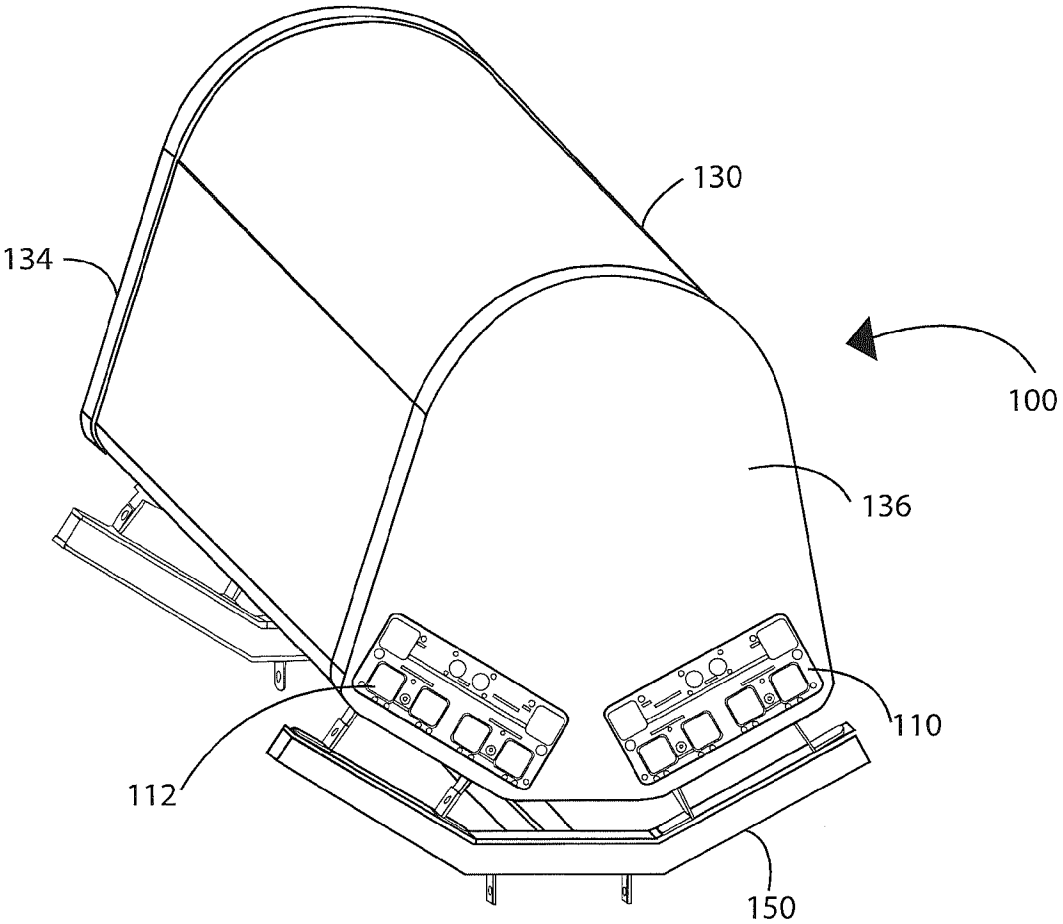
FIG. 2 is a diagram showing an assembled view of an exemplary multiple beam base station antenna system.

Referring to the drawings, and initially to FIG. 1, a multiple beam base station antenna system 100 is illustrated in an exploded view. The multiple beam antenna system 100 includes a first wireless access antenna 110, a second wireless access antenna 112, a lens 120, top and bottom lens supports 118*a* and 118*b*, a shroud 130, a shroud locking device 132, a top end cap 134, a bottom end cap 136, and a telescopic mounting structure 150. An assembled view of the multiple beam antenna is illustrated in FIG. 2.

In some embodiments, the wireless access antennas 110 and 112 may be, for example, any 65° HPBW multi-band antenna. Such multi-band antennas are referred to herein as "single beam" antennas because, while each band may have its own separately controllable beam, there is only a single beam per band. Alternatively, or additionally, single band antennas or antennas of other half power beam widths may be used. In this respect, one of the advantages of the systems described herein is that they can be readily adaptable to many different conventional, off-the-shelf single beam wireless access antennas However, by combining the conventional single beam antennas with the other components, in a modular fashion, the conventional single beam antennas may be employed to provide a multiple beam antenna system.

In operation, the lens 120 narrows the HPBW of the wireless access antennas 110 and 112 and increases the gain of the antennas 110 and 112. For example, the longitudinal axes of columns of radiating elements of the first and second wireless access antennas 110 and 112 can be aligned with the lens 120. Both wireless access antennas 110 and 112 may share the single lens, so both wireless access antennas 110 and 112 have their HPBW altered in the same manner. In one example, the HPBW of a 65° HPBW antenna is narrowed to about 33°. The multiple beam antenna system of this example therefore provides two beams of 33° HPBW, directed at +/−30° from bore sight.

The Multi-Beam base station antenna 100 as described above may be used to increase system capacity. For example, a conventional 65° HPBW antenna could be replaced with a dual beam multi-beam base station antenna system 100 as described above. In this example a single 120° sector would be converted into two 60° sectors. This would increase the traffic handling capacity for the base station. In another example, the multi-beam base station antenna system 100 may be employed to reduce antenna count at a tower or other mounting location.

Figure 3:
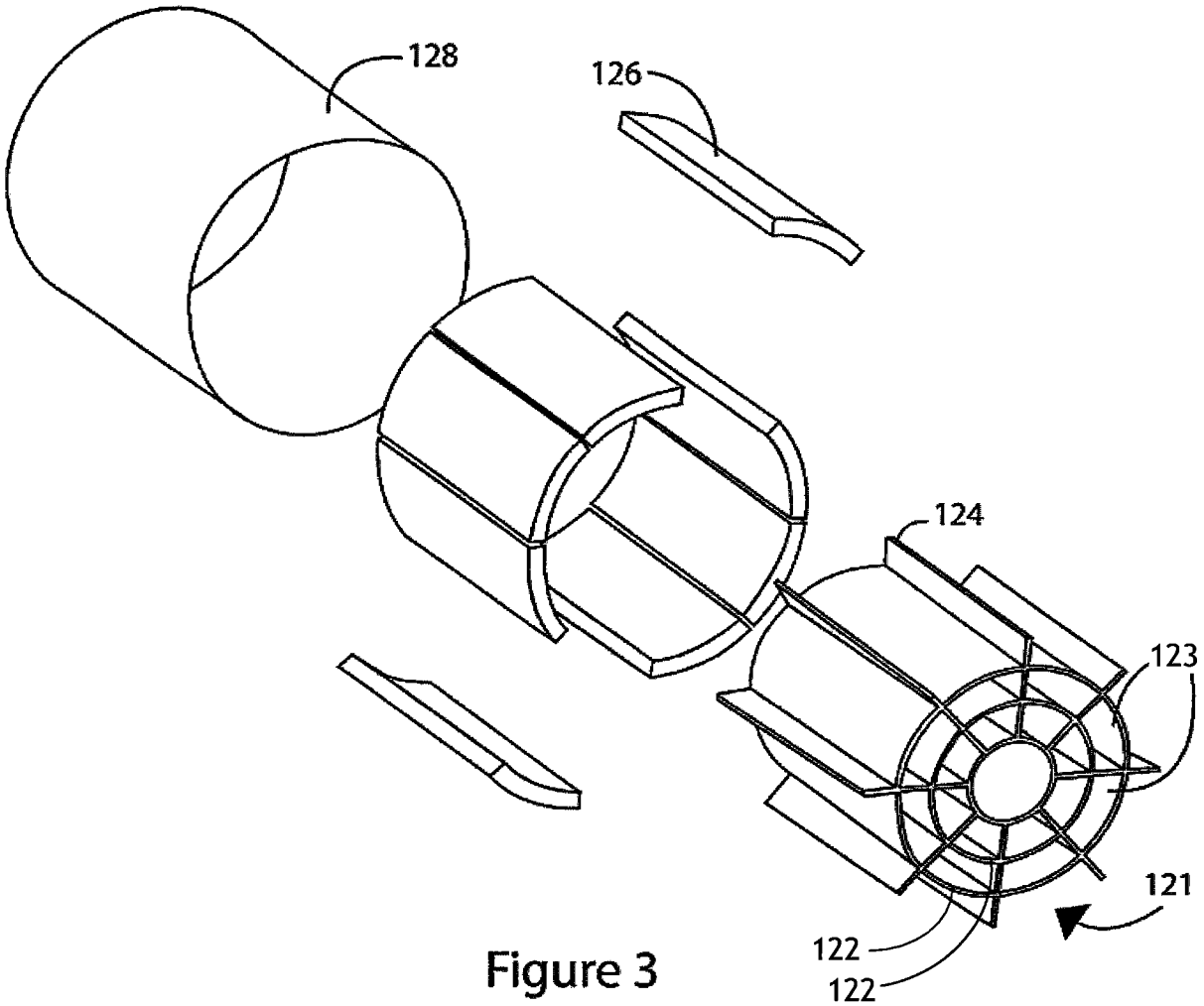
FIG. 3 is a diagram showing an exemplary Luneburg lens.

The lens 120 preferably comprises a variation on a Luneburg lens. A conventional Luneburg lens is a spherically symmetric lens that has a varying index of refraction inside it. In this case, the lens is preferably shaped as a cylinder. Referring to FIG. 3, the lens 120 comprises a core 121, a plurality of dielectric panels 126, and an outer film bag 128. The film bag 128 may be Mylar, or any other suitable durable thin-walled bag. The core 121 may comprise an extruded PVC structure having a plurality of concentric coaxial cylinders 122 connected by radial ribs 124. The concentric cylinders 122 and radial ribs 124 subdivide the core 121 into separate compartments 123. The ribs 124 preferably extend past the outermost cylinder 122, and provide a structure for holding the dielectric panels 126 in place. In some embodiments, each rib 124 may extend past the outermost cylinder 122. In other embodiments, only some of the ribs 124 extend past the outermost cylinder. For example, two ribs may extend past the outermost cylinder to establish two grooves for holding two corresponding panels 126 in place. Optionally, outer rib components may be used that do not corresponding to internal ribs components.

Figure 6:
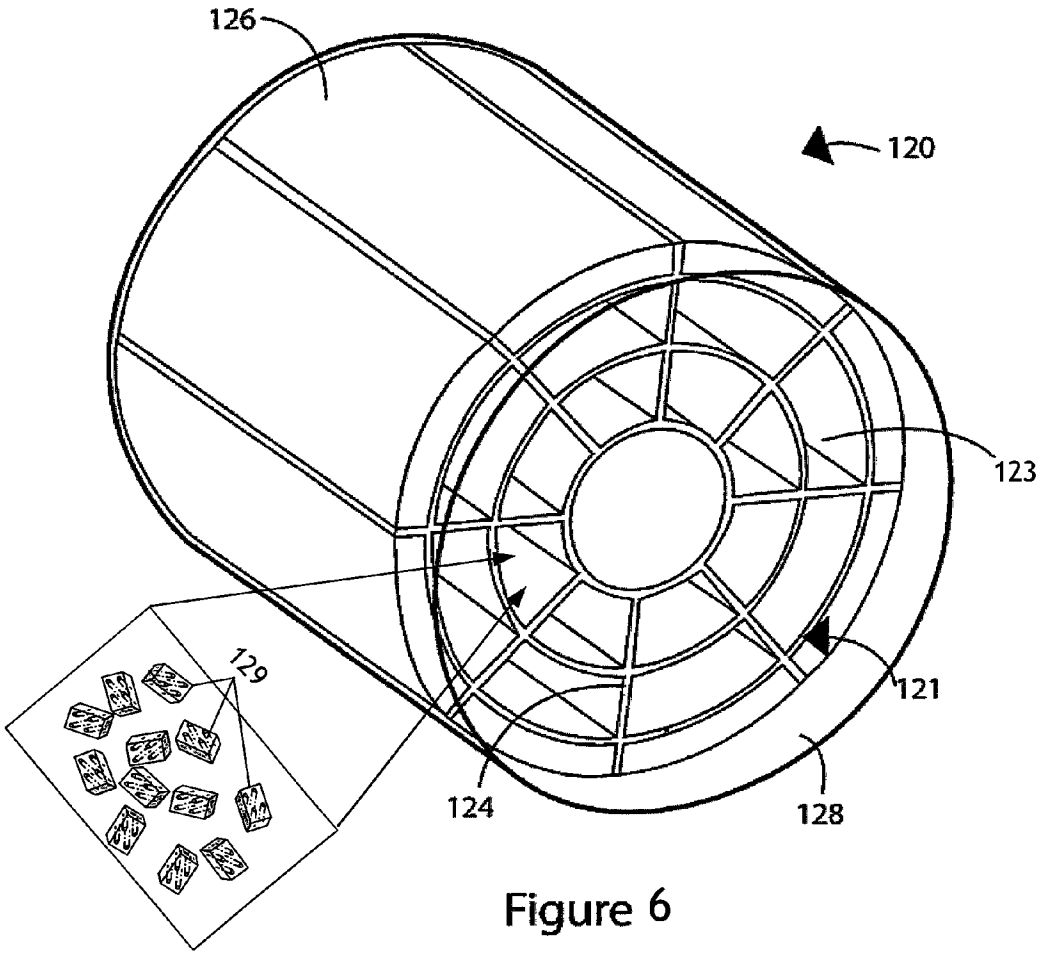
FIG. 6 is a diagram showing an exemplary lens having compartments filled with a plurality of randomly distributed dielectric material pellets.

The compartments 123 may be filled with pellets or blocks of dielectric material. In some embodiments, all of the interior compartments 123 are filled with the dielectric material pellets. The dielectric material pellets focus the radio-frequency energy that radiates from, and is received by, the wireless access antennas. The dielectric material may be of the type described in U.S. Pat. App. Pub. No. 2011/0003131, which is incorporated by reference. In one example, as illustrated in FIG. 6, the dielectric material pellets 129 comprise a plurality of randomly distributed particles. The plurality of randomly distributed particles is made of a lightweight dielectric material. The range of densities of the lightweight dielectric material can be, for example, 0.005 to 0.1 g/cm$^3$. At least one needle-like conductive fiber is embedded within each particle. Where there are at least two conductive fibers embedded within each particle, the at least two conductive fibers are in an array like arrangement, i.e. having one or more row that include the conductive fibers. Preferably, the conductive fibers embedded within each particle are not in contact with one another.

In one example, the dielectric pellets are homogeneous. In other embodiments, the compartments 123 in the core 121 may be filled with dielectric material pellets having different dielectric constants. In this way, a dielectric gradient may be created. For example, the inner-most cylinder 122 may have dielectric material pellets having a relatively high dielectric constant and the compartments of the outermost may be filled with dielectric material pellets having a relatively low dielectric constant. Other variations may also be used.

Wireless access antenna systems are subject to vibration and other environmental factors. The compartments 123 of the core 121 assist in the reduction of settling of the dielectric material pellets, increasing the long term physical stability and performance of the lens 120. In addition, the dielectric material pellets may be stabilized with slight compression and/or a backfill material. Different techniques may be applied to different compartments 123, or all compartments 123 may be stabilized using the same technique.

Figure 4:
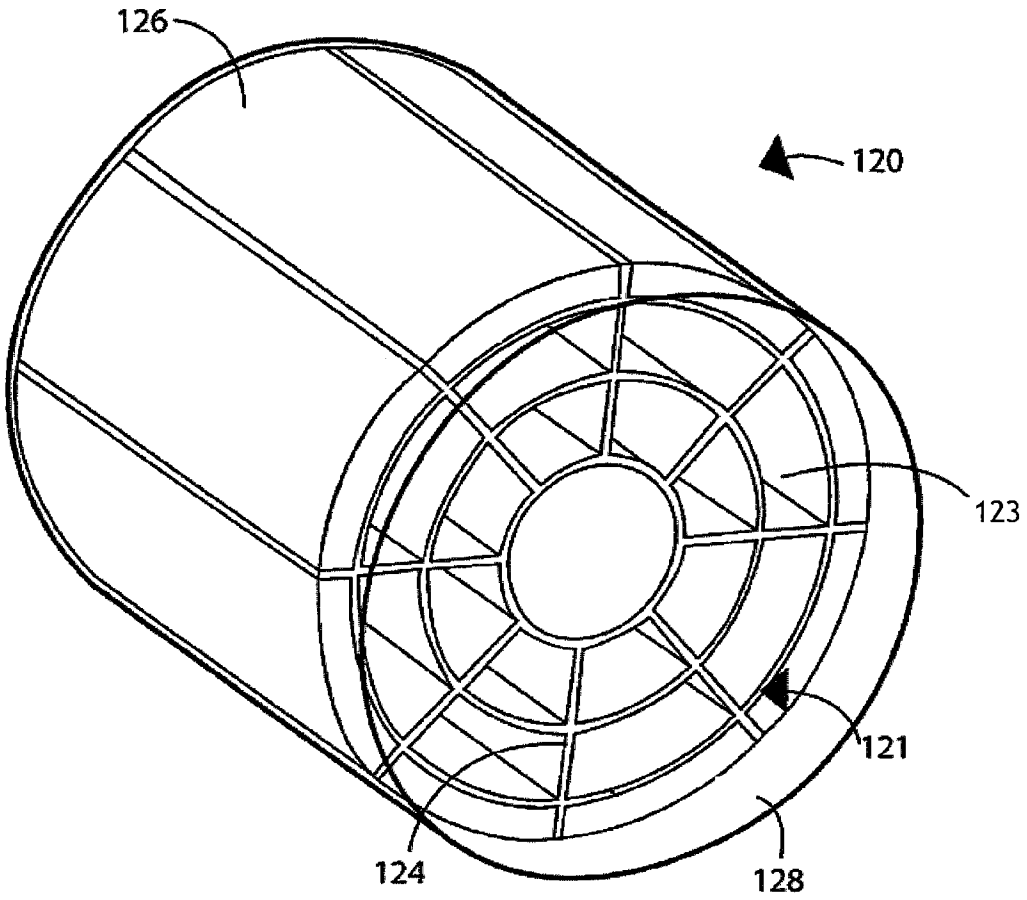
FIG. 4 is a diagram showing an exemplary assembled lens (or section of a modular lens)

An assembled lens 120 (or section of a modular lens) is illustrated in FIG. 4. The dielectric panels 126 are fitted in between the outermost ribs 124 of the core 121, and the film bag 128 covers the assembly. The dielectric panels 126 may be, for example, Styrofoam panels. The film bag 128 may be used to provide a vacuum seal to remove air and control moisture penetration.

In one example, the lens 120 is modular in the direction of the longitudinal axis of the cylinder. For example, a lens segment including a core 121 and dielectric panels 126 may be made in one-foot lengths, and an appropriate number of lens segments may be coupled in series to make lenses 120 of four to eight feet in length. For example, in the embodiment shown in FIG. 4*a*, three lens segments 120*a*, 120*b*, and 120*c* are coupled to make a lens 120. In one embodiment for a wireless application requiring a total lens length of 1.3 meters, the total lens length may be realized by combining two 0.65 meter modular lenses 120. As another example, a lens length of 2.5 meters may be realized by combining four modular lenses 120 having lengths of 0.625 meters. Each lens segment 120*a*, 120*b*, and 120*c* may include multiple inner compartments 123, or may include a single compartment 123.

Figure 4A:
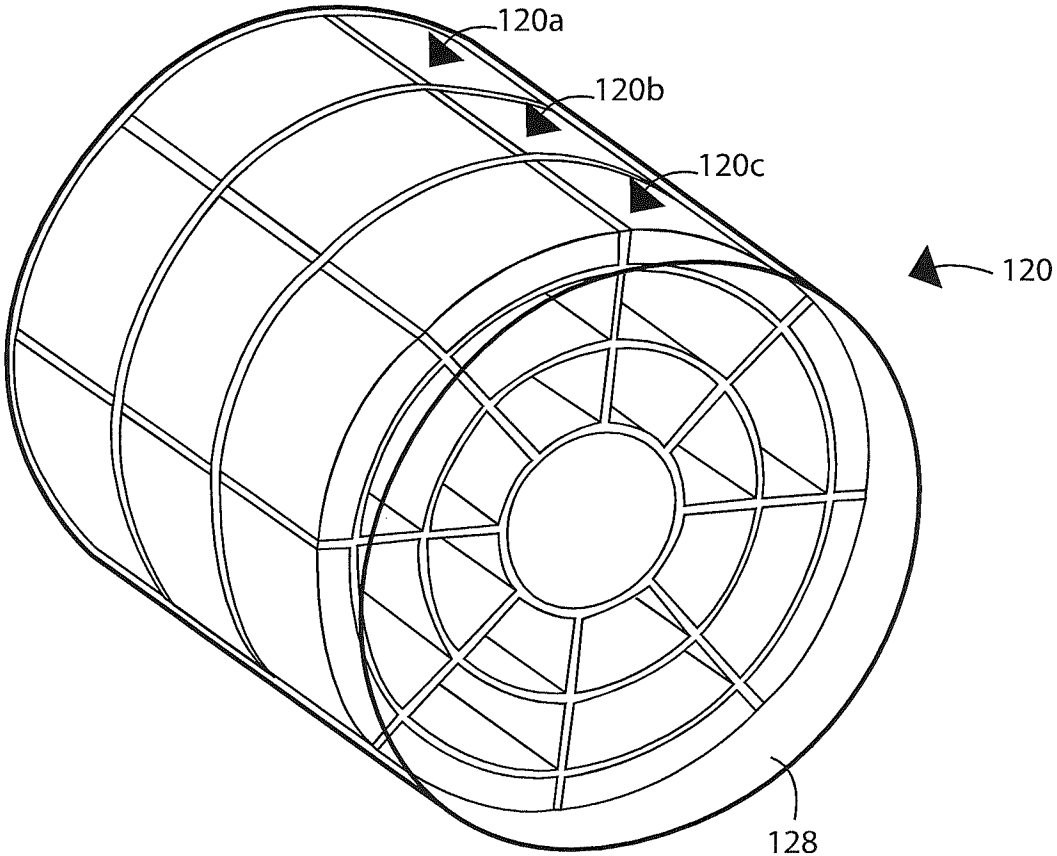
FIG. 4*a* is a diagram showing an exemplary lens that is modular in the direction of the longitudinal axis of the cylinder.

When the lens is modular in the direction of the longitudinal axis of the cylinder, outer panels 126 may vary in length corresponding to the length of the lens segment 120*a*, 120*b*, and 120*c*, as shown in FIG. 4*a*. Optionally, or additionally, outer panels 126 may span two or more lens segments 120*a*, 120*b*, and 120*c*.

Figure 4B:
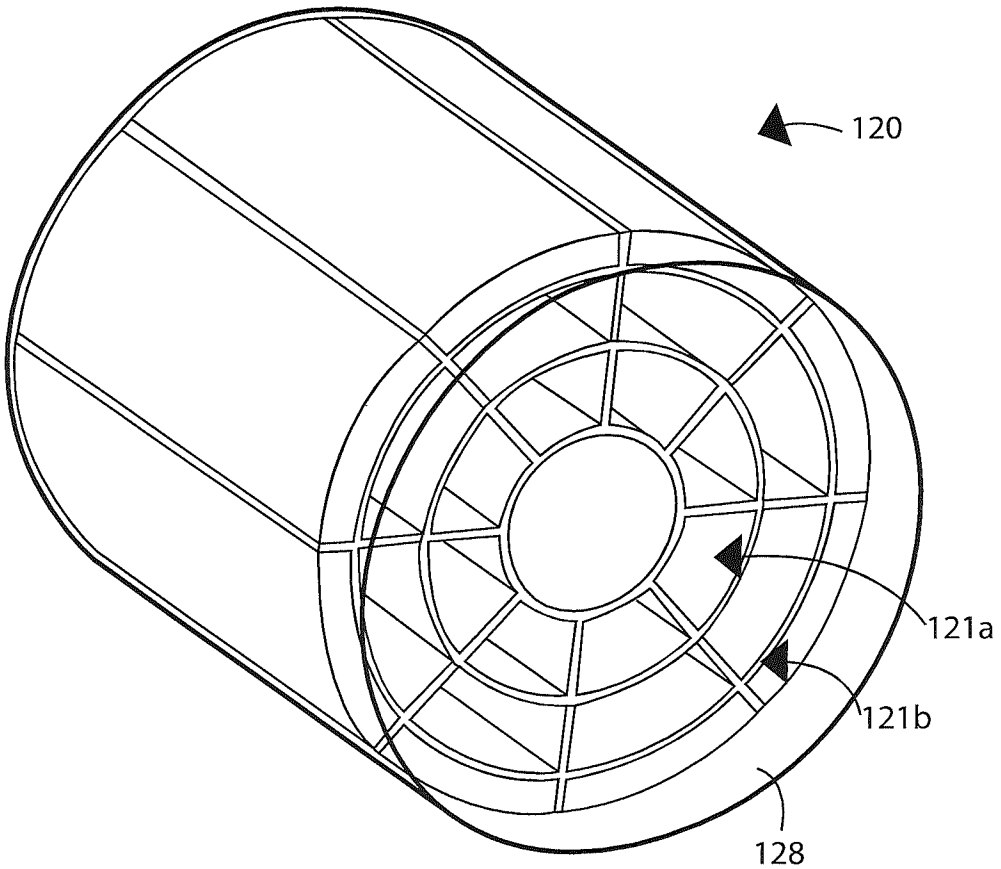
FIG. 4*b* is a diagram showing an exemplary lens that is modular in the direction of the radius of the cylinder.

In some embodiments, the lens 120 may be modular in the direction of the radius of the cylinder. This is shown in FIG. 4*b*. For example, the core 121*a* may be inserted into another, larger-radius cylindrical core 121*b*. In this way, lenses 120 having diameters from about 315 mm to 500 mm may be constructed using common components and tooling.

Returning to FIGS. 1 and 2, the top and bottom lens supports 118*a* and 118*b* space the lens 120 a desired distance from the first and second wireless access antennas. The lens 120 is spaced such that the apertures of the wireless access antennas point at a center axis of the lens. In some embodiments, the top and bottom lens supports 118*a* and 118*b* are shaped to rest against the outer casings or radomes of the first and second antennas 110 and 112. This allows the lens 120 and the first and second antennas 110 and 112 to be maintained in relative spatial positions.

The shroud 130 may be made of a suitable fabric material, a suitable rigid material, or a combination of suitable materials. The shroud 130 is placed over the combination of the wireless access antennas 110 and 112 and the lens 120, and secured in place, for example, by sliding the shroud locking device 132 over locking grooves on the shroud 130. Other methods of securing the shroud in place may also be used. The shroud 130 may fully or partially enclose the telescopic mounting structure 150, or the mounting structure 150 may be outside the shroud 130.

In some embodiments, the top and bottom end caps 118*a* and 118*b* provide some environmental protection. Preferably, each of the wireless access antennas 110 and 112 and the lens 120 are environmentally enclosed so the shroud 130 and end caps 134 and 136 serve to reduce intrusion from insects, birds, and pests. Alternatively, or additionally, the shroud 130 and end caps 118*a* and 118*b* may be environmentally sealed.

Figure 5:
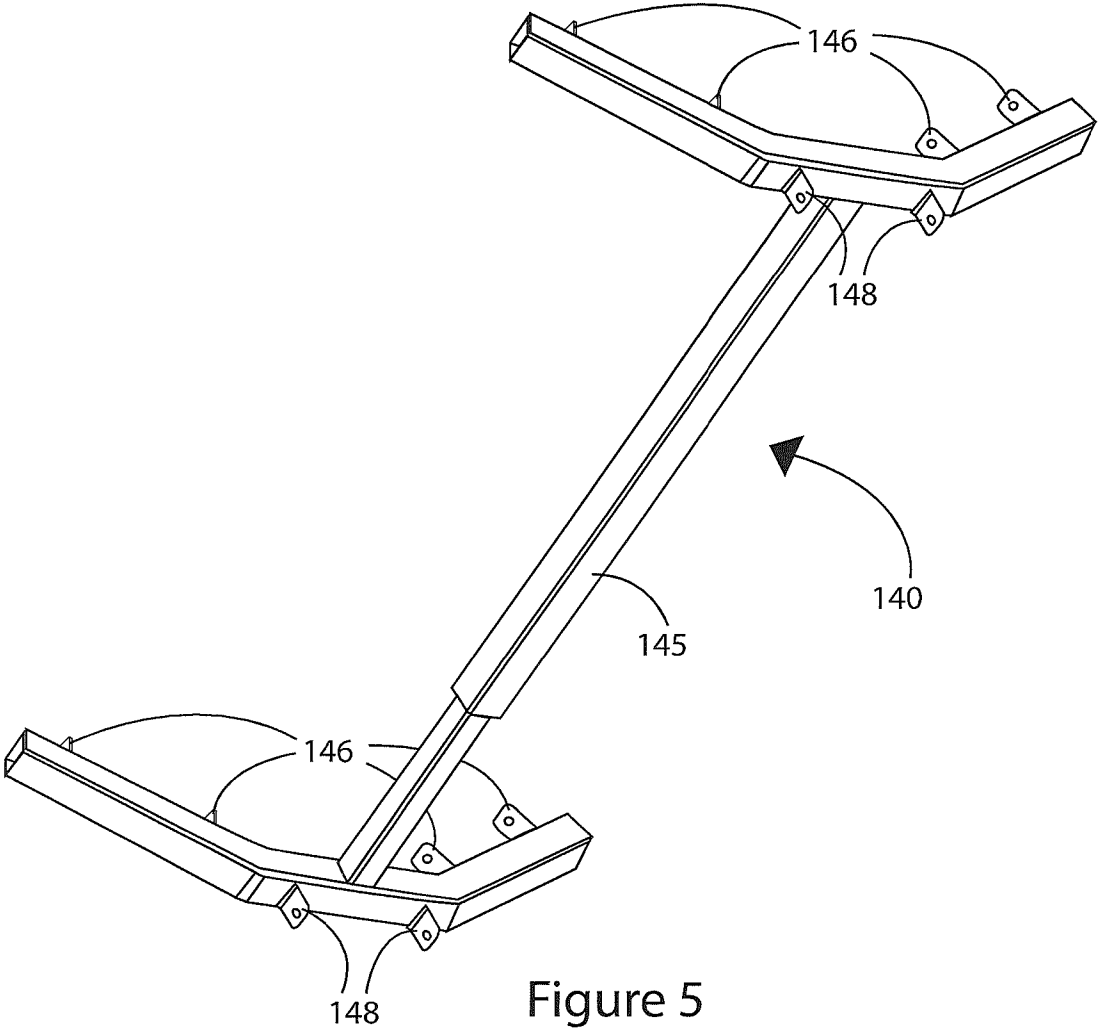
FIG. 5 is a diagram showing an exemplary telescopic mounting structure for a multiple beam base station antenna system.

The telescopic mounting structure 150 is shown in more detail in FIG. 5. Preferably, the mounting structure telescopes to adapt to antenna lengths of four feet to eight feet. Other lengths may also be used. In the embodiment shown in FIG. 3, the telescopic mounting structure 150 includes a top mounting arm 142, a bottom mounting arm 144, a telescopic vertical member 145, and rear mounting tabs 148.

In the embodiment shown in FIG. 5, the top and bottom mounting arms 142 and 144 include two sets of mounting tabs 146 each that are adapted to match up with mounting tabs on a conventional wireless access antenna. The top and bottom mounting arms 142 and 144 are angled inward. In one example, the mounting arms are angled inward at about 30 degrees so that, when the wireless access antennas are mounted on the telescopic mounting structure, the antennas will be angled inward at +/−30 degrees from perpendicular to the telescopic mounting structure. Other angles may be used.

Preferably, the rear mounting tabs 148 are dimensioned and spaced similarly to mounting tabs found on a conventional wireless access antenna. This allows the telescopic mounting structure to be mounted to a pole, tower, or other structure in the same manner as a conventional wireless access antenna would be mounted.

While the foregoing examples are described with respect to two multi-beam antennas, additional embodiments including, for example, three multi-band antennas sharing a single lens are also contemplated. In these examples, three beams may be produced from a single multi-beam antenna system, one at bore sight, and two off bore site. Additional configurations are also contemplated.

Though the invention has been described with respect to specific preferred embodiments, many variations and modifications will become apparent to those skilled in the art upon reading the present application. For example, the invention can be applicable for radar multi-beam antennas. The invention is therefore that the apprehended claims be interpreted as broadly as possible in view of the prior art to include all such variations and modifications.

We claim:

1. A radio frequency lens comprising:

a plurality of compartments arranged to form a first cylinder including a set of concentric, coaxial cylinders, wherein the compartments are formed at least in part by a plurality of dielectric panels and a plurality of radially extending ribs, and wherein the dielectric panels are arranged to form the first cylinder; and a plurality of randomly distributed pellets of dielectric material that fill the plurality of compartments.

2. The radio frequency lens of claim 1, wherein the randomly distributed pellets of dielectric material include pellets formed of different materials having different dielectric properties.

3. The radio frequency lens of claim 1 further comprising a film bag for containing the plurality of compartments.

4. The radio frequency lens of claim 3, wherein the film bag is vacuum sealed around the first cylinder.

5. The radio frequency lens of claim 1, wherein the plurality of compartments comprises a first set of compartments, the radio frequency lens further comprising a second set of compartments formed in a ring, where in the second set of compartments is adapted to receive the first cylinder to form a second cylinder having a larger diameter than the first cylinder.

6. The radio frequency lens of claim 1, wherein the plurality of compartments comprises a first set of compartments, the radio frequency lens further comprising a second set of compartments formed in a second cylinder, wherein the first cylinder has a first length, wherein the second cylinder is adapted to connect to the first cylinder to form a third cylinder having a length larger than the first length.

7. The radio frequency lens of claim 1 further comprising a plurality of radially extending ribs, wherein the ribs and the concentric, coaxial cylinders define at least some of the plurality of compartments.

8. The radio frequency lens of claim 1 wherein the plurality of randomly distributed pellets of dielectric material are stabilized by compression.

9. The radio frequency lens of claim 1 wherein the plurality of randomly distributed pellets of dielectric material are stabilized by a backfill material.

10. A radio frequency lens comprising:

a plurality of cylinders, the cylinders being concentric and coaxial to one another;

a plurality of ribs intersecting at least some of the plurality of cylinders to form a plurality of compartments for holding dielectric materials, the ribs extending outward past an outermost cylinder of the plurality of cylinders to form a plurality of outer grooves holding dielectric panels; and a film bag for containing the plurality of cylinders, the plurality of ribs, the dielectric materials, and the dielectric panels, wherein the film bag is vacuum sealed around the plurality of cylinders, the plurality of ribs, the dielectric materials, and the dielectric panels.

11. A radio frequency lens comprising:

a plurality of cylindrical lens segments each having a longitudinal axis, each cylindrical lens segment including an inner compartment for holding dielectric materials and at least two outer grooves for holding dielectric panels, wherein the cylindrical lens segments are stacked along the longitudinal axes of the cylindrical lens segments; and a film bag for containing the plurality of cylindrical lens segments, the dielectric materials, and the dielectric panels.

12. A radio frequency lens comprising:

a core that includes a plurality of coaxial cylinders and a plurality of radially extending ribs that bisect at least some of the coaxial cylinders to subdivide the core into a plurality of separate compartments, wherein the ribs extend outward past an outermost cylinder of the plurality of coaxial cylinders and form a plurality of outer grooves holding dielectric panels; and dielectric material filling the plurality of separate compartments.

13. The radio frequency lens of claim 12 further comprising a film bag, wherein the core and the dielectric material are vacuum sealed within the film bag.

14. The radio frequency lens of claim 13 wherein the film bag comprises a mylar bag.

15. The radio frequency lens of claim 12 wherein the plurality of separate compartments are filled by a plurality of randomly distributed pellets of the dielectric material.

16. The radio frequency lens of claim 15 wherein the plurality of randomly distributed pellets of the dielectric material are stabilized by compression.

17. The radio frequency lens of claim 15 wherein the plurality of randomly distributed pellets of the dielectric material are stabilized by a backfill material.

* * * * *